US011306567B2

(12) United States Patent
Elkins et al.

(10) Patent No.: US 11,306,567 B2
(45) Date of Patent: Apr. 19, 2022

(54) BALL LIFT SLEEVE AND RETRIEVAL TOOL FOR OIL AND GAS WELLS

(71) Applicants: Ron Elkins, Aztec, NM (US); Arthur Sullivan, Bloomfield, NM (US)

(72) Inventors: Ron Elkins, Aztec, NM (US); Arthur Sullivan, Bloomfield, NM (US)

( * ) Notice: Subject to any disclaimer, the term of this patent is extended or adjusted under 35 U.S.C. 154(b) by 0 days.

(21) Appl. No.: 16/988,467

(22) Filed: Aug. 7, 2020

(65) Prior Publication Data

US 2021/0040804 A1 Feb. 11, 2021

Related U.S. Application Data

(60) Provisional application No. 62/883,653, filed on Aug. 7, 2019, provisional application No. 62/927,495, filed on Oct. 29, 2019.

(51) Int. Cl.

| | |
|---|---|
| ***E21B 43/12*** | (2006.01) |
| ***E21B 23/00*** | (2006.01) |
| ***F04B 47/12*** | (2006.01) |
| ***E21B 33/12*** | (2006.01) |

(52) U.S. Cl.

CPC ..... *E21B 43/121* (2013.01); *E21B 23/00* (2013.01); *F04B 47/12* (2013.01); *E21B 33/12* (2013.01)

(58) Field of Classification Search

CPC ..... E21B 43/121; E21B 43/13; E21B 43/122; E21B 43/123; E21B 23/00; E21B 33/12; F04B 47/12

See application file for complete search history.

(56) References Cited

U.S. PATENT DOCUMENTS

| | | | | |
|---|---|---|---|---|
| 7,021,387 | B2 | 4/2006 | Lee | |
| 7,121,335 | B2 | 10/2006 | Townsend | |
| 8,485,263 | B2 | 7/2013 | Lembcke | |
| 9,297,247 | B2 | 3/2016 | Lea, Jr. | |
| 9,869,165 | B2 | 1/2018 | Hightower et al. | |
| 9,890,621 | B2 | 2/2018 | Bishop | |
| 10,060,235 | B2 | 8/2018 | Damiano et al. | |
| 2003/0215337 | A1 | 11/2003 | Lee | |
| 2004/0226713 | A1 | 11/2004 | Townsend | |
| 2012/0080198 | A1 | 4/2012 | Lembcke | |
| 2012/0318524 | A1 | 12/2012 | Lea, Jr. | |
| 2016/0097265 | A1 | 4/2016 | Bishop | |
| 2016/0108710 | A1 | 4/2016 | Hightower et al. | |
| 2017/0002634 | A1* | 1/2017 | Casey | F04B 47/12 |
| 2017/0058651 | A1* | 3/2017 | Damiano | E21B 43/121 |

* cited by examiner

*Primary Examiner* — George S Gray
(74) *Attorney, Agent, or Firm* — Kameron W. Kramer

(57) ABSTRACT

A ball lift sleeve and retrieval tool comprising a sleeve for disposing in tubing of a well, the sleeve defining a first passage from a first proximal end to a first distal end, and a retrieval tool for disposing in the tubing of the well, the retrieval tool being separately moveable in the tubing between mated and unmated conditions with respect to the sleeve, the retrieval tool at least partially mating with the first distal end of the sleeve when in the mated condition and at least partially closing fluid communication through the passage of the sleeve when mated therewith.

8 Claims, 25 Drawing Sheets

BALL LIFT SLEEVE AND RETRIEVAL TOOL FOR OIL AND GAS WELLS

CROSS-REFERENCE TO RELATED APPLICATION

This application claims the benefit of U.S. Provisional Patent Application Ser. No. 62/883,653 filed Aug. 7, 2019, titled "Multi-Piece Plunger," and U.S. Provisional Patent Application Ser. No. 62/927,495 filed Oct. 29, 2019, titled "Ball Lift Sleeve Retrieval Tool for Oil and Gas Wells," and the subject matter thereof is incorporated herein by reference thereto.

TECHNICAL FIELD

The present invention relates generally to oil and gas wells, and more particularly to ball sleeve and retrieval tool used in a multi-piece plunger lift system.

BACKGROUND ART

Plunger lift systems are consistently used in oil and gas wells. These systems rely on natural buildup of pressure in a shut-in gas well and gas velocity in a well struggling to flow. A bumper spring is in place at the bottom of the well where the plunger cycle begins. When the well is shut-in, the plunger falls through the gas and liquid toward the bumper spring. The plunger then travels up toward the surface when the well is opened. There is typically a controller that opens a valve that controls the shut-in pressure and creates a differential pressure that forces the plunger and the liquid to the surface. The plunger provides a seal between the liquid and the gas, which allows for the well's own energy to be used to lift liquids out of the well.

Plunger lift systems are well-known in the prior. They are typically used in oil and gas wells to remove liquids from the wellbore, utilizing the pressure in the well. U.S. Pat. No. 9,869,165 B2, Hightower et al., entitled "Plunger Lift Arrangement" (the "165 patent"), U.S. Pat. No. 9,297,247 B2, Lea, Jr., entitled "Plunger Lift Slug Controller," U.S. Pat. No. 8,485,263 B2, Lembcke, entitled "Multi-Sleeve Plunger for Plunger Lift Systems," are just a few of the recent patents that are targeted toward plunger lift systems.

There are many types of lifting plunger, as seen for example in the referenced patents, that have been developed to address many of the problems encountered by two piece plungers. The industry has tried many variations of these types, including, internal dart, shift rod, and shift collapsing plungers, just to name a few. Each of these variations have their own drawbacks.

Two piece plungers were a huge step in the industry as they provided a means to move large amounts of liquids with little off time. The two piece plunger falls against flow and rises bringing liquid to surface continuously with little interruption in flow. This type of plunger was even challenging the use of pumping units, pump jacks. These pump jacks are much more expensive artificial lift systems used to handle these conditions. This development in plunger technology meant the rest of the plunger lift companies had to catch up.

The problems encountered by the plungers contained in the prior art, including, but not limited to: 1) the impurities in gas and liquid production are present and have to be addressed; 2) various flow rates and velocities are in encountered over production days requiring plunger adjustments (opening, closing ports, checking shifting mechanism, adjusting clutches, etc.) daily by skilled people; 3) as the plunger is falling, the shifting mechanism will slam shut when it hits liquid, sending the plunger to the surface with no load at high rates of speed causing extreme damage and hazards. Note that the maximum velocity attainable by plunger is the speed of sound; 4) most have to be designed specifically for the wells and are not readily interchangeable with other wells, with flow rates and liquid rates at the time of installation. This can include different inner diameter and outer diameter bores, specific port sizing, and shifting valves sizes; and 5) not including labor skill level required to operate, these plungers cost 3 to 5 times that of a two piece sleeve.

Referring to problem 1) listed above, if there is a valve shifting that gets stuck by a little sand, it stops running, creating a restriction in tubing bore and having to be mechanically removed. If one of the ports get trash, it will not get to the bottom. If the shifter gets stuck in open position it will stay on bottom and not come back up to the surface. This means it is highly labor intensive and requires skilled operators to maintain. This is the one of the greatest problems in this type of system With all of that said, why do producers use these systems predominately over the two-piece pacemaker. The 165 patent has operating parameters that are vastly different from conventional plunger operations, thus requiring extensive training and diligence by the operators. Pump operators want fast fall even under flowing conditions. Most need and use standing valves at bumper springs so when the sleeve does not make contact with the ball, the only way to retrieve it is with a wire line or a rig. The shifting type can be blown to surface 95% of the time.

The first two piece plungers were used on high gas volume medium liquid rate wells with great results. As the wells matured rates fell and the issues the present invention addresses appeared. Until a few years ago, the industry could not tell what was going on. The Echometer company developed a program fast enough to track these fast plungers running at 1000 hz. Although relatively new and unknown to the industry, we are now able to see the problems. When Encana found and started developing the San Juan basin oil play on horizontal wells, it was a testing ground for a new type of production technique.

Operators and employees were cherrypicked and everything was tried. The only rule was to prove the processes and to lower the cost after proven. That brings us to today. The industry only uses two piece plungers for production in oil barrel rates from 10 to 800 per day with gas rates from 13 to 2,300 Mcfd.

Plunger lifts are typically used in high gas/liquid ratio gas and oil wells but are versatile enough to be used in lower gas/liquid ratio wells as well. A two piece plunger lifts fluids when the ball and sleeve are coupled, but the ball and sleeve are designed to fall when separate. As with other artificial lift methods, the purpose of a plunger lift is to remove liquids from the wellbore so that the well can be produced at the lowest bottom-hole pressure and maximum rate. Sleeve and two piece plungers contained in the prior art do not address certain problems in the industry, specifically the fact that the flow characteristics at the bottom of the hole are different than the flow in the tubing and casing production string. At the area above the bumper spring and to approximately 600 feet above the bumper spring, the gas and liquid is forced to the walls of the tubing by the bumper spring.

As flow moves up the tubing, the friction on the tubing redirects the velocity to the center of the tubing, thus forming a sealing between the ball and the sleeve, and in turn pushing the sleeve and ball to the surface. The area where the flow characteristics change, the transition area, is where problems arise. There are problems with getting the lifting sleeve through the transition area, and in horizontal production, these problems are only compounded. Oftentimes, the velocity of flow on the wall will stop the sleeve from reaching the ball. If that happens, the ball may drop before reaching the transition area, causing a drop in pressure of the entire system. The industry calls this the "yo-yo effect" or "dropping the ball."

Dropping the ball increases tubing wear (by making so many lifting attempts to achieve one actual lift, wearing holes in bottom of tubing, etc.), plus dropping multiple loads logging off wells. Therefore, most producers are afraid of these types of lift systems. Producers want and need fast fall rates, making the need for the decrease in dropping the ball rates a huge boom for the industry.

The present invention provides a two piece plunger lift (ball and sleeve) for use in oil and gas wells. More specifically, a plunger lift having a sleeve with a bore thru that is positioned between a bumper spring and ball. Gas flow will lift the sleeve off the bumper spring carrying the ball through an impacted area until making contact with the descending plunger at which point it is inserted into plunger transferring upward lift to plunger. The sleeve will then descend back to the bumper spring and await the ball to drop and be inserted in top of sleeve which will act as check valve holding fluid in tubing until next cycle.

The present invention works in conjunction with prior art sleeves and/or two piece plungers to address and overcome problems by providing a device that delivers the load out of the transition area simply without adjustments required. Many prior art systems use a small sleeve instead of a ball and latch type upper sleeve instead of a separator rod. Prior art sleeves have limited flow through the center, causing a very slow descent to reach the bumper spring. Even a more hollow sleeve still has enough restriction in the last approximately 300 feet or so from the bumper spring due to the formation pressure and compressor injection pushed to the outside of the tubing by the head of the bumper spring that it is slowed, and oftentimes comes to a complete stop. This means the sleeve is unable to connect with the ball, and no seal can be formed. The present invention provides is designed to continuously operate by carrying the ball through this restricted area up to the point that the upward pressure comes off the outside of the tubing and is equal pressure throughout the walls of the tubing allowing the pressure to flow through the center of the upper cylinder more freely which improves time efficiency of each cycle immensely The present invention provides a ball and ball lift sleeve to be used in plunger lift gas/liquid wells. To easily remove the ball lift sleeve of the present invention out of the well when not in use, a special tool is needed. Two such embodiments of tools to remove the ball lift sleeve from the well are included in the present invention.

Certain embodiments of the invention have other steps or elements in addition to or in place of those mentioned above. The steps or element will become apparent to those skilled in the art from a reading of the following detailed description when taken with reference to the accompanying figures.

None of the prior art fully addresses the problems resolved by the present invention. The present invention overcomes these limitations contained in the prior art by providing a multi-piece plunger and ball sleeve retrieval tool for plunger lift systems that is sturdy, reliable, easy to use, and inexpensive.

DETAILED DESCRIPTION OF THE INVENTION

Figure 1:
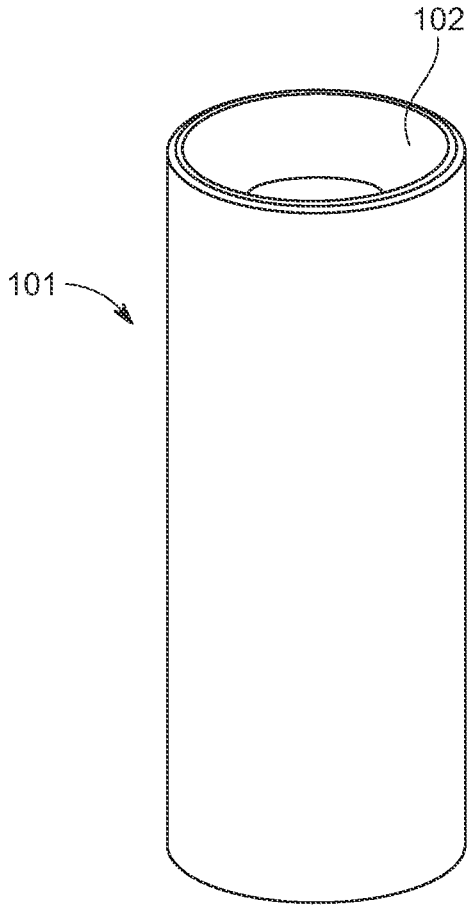
FIG. 1 illustrates a side perspective view of ball lift sleeve.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the plunger and ball lift sleeve retrieval tool or the oil/gas well, as the case may be, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures.

The present invention provides a ball and ball lift sleeve to be used in plunger lift gas/liquid wells. To easily remove the ball lift sleeve of the present invention out of the well when not in use, a special tool is needed. Two such embodiments of tools to remove the ball lift sleeve from the well are included in the present invention.

FIG. 1 illustrates a side perspective view of ball lift sleeve 101. Ball seat 102 is disposed in the inner diameter of ball lift sleeve 101.

Figure 2:
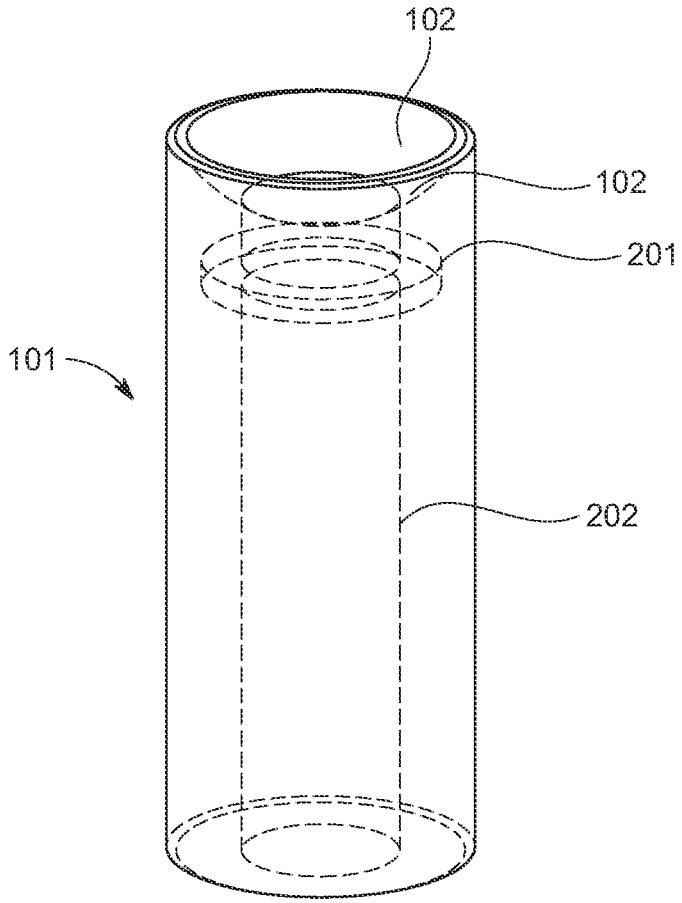
FIG. 2 illustrates a cross-sectional side perspective view of ball lift sleeve.

FIG. 2 illustrates a cross-sectional side perspective view of ball lift sleeve 101. Flow thru 202 extends through ball lift sleeve 101. Ball seat 102 is disposed in the inner diameter of ball lift sleeve 101 at the distal end of flow thru 202. Catch groove 201 is disposed in ball lift sleeve 101.

Figure 3:
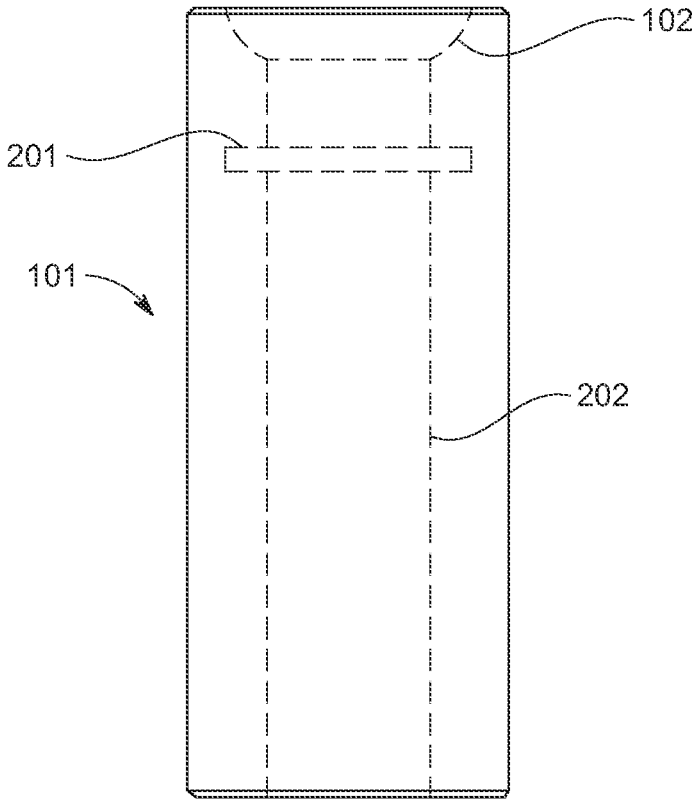
FIG. 3 illustrates a cross-sectional side elevation view of ball lift sleeve.

FIG. 3 illustrates a cross-sectional side elevation view of ball lift sleeve 101. Flow thru 202 extends through ball lift sleeve 101. Ball seat 102 is disposed in the inner diameter of ball lift sleeve 101 at the distal end of flow thru 202. Catch groove 201 is disposed in ball lift sleeve 101.

Figure 4:
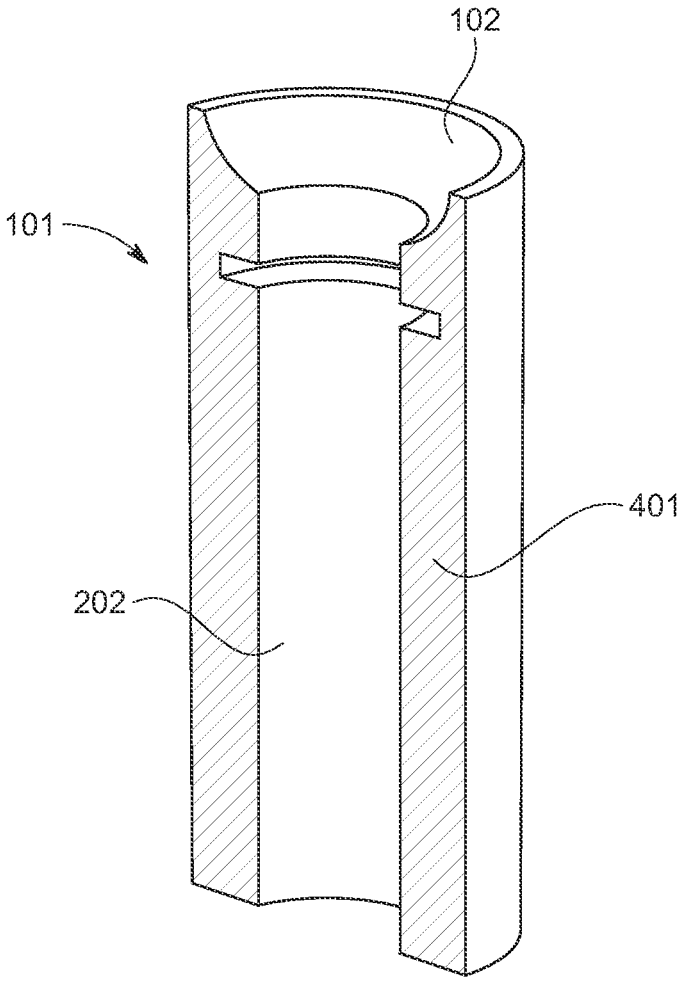
FIG. 4 illustrates a cut-away side perspective view of ball lift sleeve.

FIG. 4 illustrates a cut-away side perspective view of ball lift sleeve 101. Flow thru 202 extends through ball lift sleeve 101. Ball seat 102 is disposed in the inner diameter of ball lift sleeve 101 at the distal end of flow thru 202. Catch groove 201 is disposed in ball lift sleeve 101. Thickness of ball lift sleeve wall 401 can vary as required.

Figure 5:
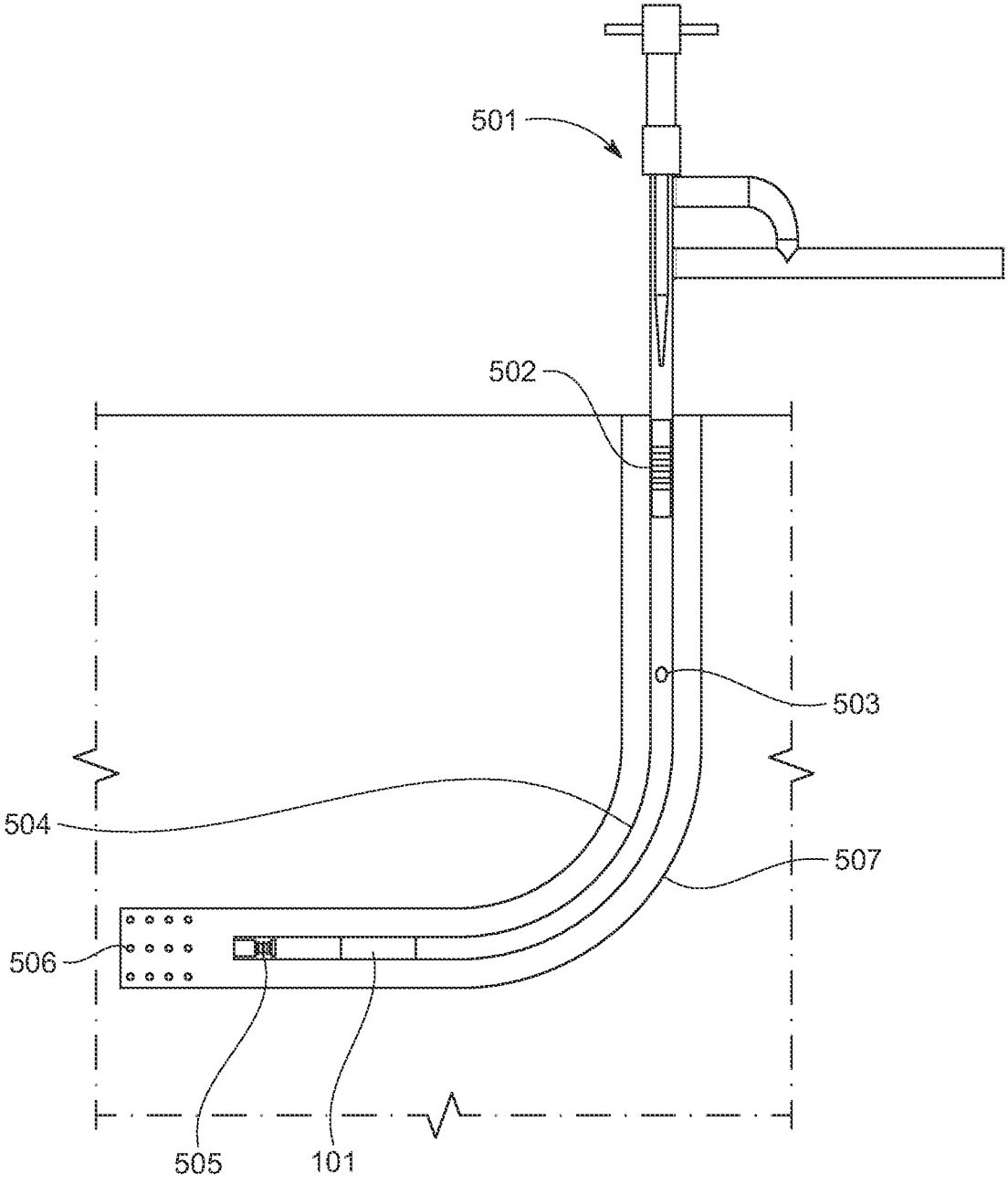
FIG. 5 illustrates a schematic representation of a plunger lift well.

FIG. 5 illustrates a schematic representation of a plunger lift well 501. Lift sleeve 502 is disposed in tubing 504, which deploys in casing production string 507. Ball 503 is disposed in tubing 504 between lift sleeve 502 and ball lift sleeve 101. Bumper spring 505 and perforations 506 are at the distal end of the plunger lift well 501. The size of ball 503 is such that flow goes all around it when it is disposed in tubing 504.

Ball lift sleeve 101 has flow thru 202 that defines ball seat 102. Ball 503 fits against ball seat 102, sealing fluid flow through flow thru 202 during operation. The outer surface of ball lift sleeve 101 can have ribbing or other means for creating a desired pressure differential. When in use, ball lift sleeve 101 and ball 503 dispose separately in tubing 504. Ball lift sleeve 101 is dropped first to land near the bottom of the well, falling into any liquid near the bottom of the well and contacts bumper spring 505. Ball 503 is then dropped into tubing 504.

When ball 503 reaches ball lift sleeve 101, they come into contact to form a seal. Once the seal is formed, the well can be operated. Gas enters through perforations 506 and travels up the tubing 504 to the surface. Liquid that accumulate in the well creates back pressure that slows gas production. Eventually, gas flow will lift coupled ball 503 and ball lift sleeve 101 off bumper spring 505 and bring them toward the surface. This allows for the liquid load to be removed from the well.

Coupled ball lift sleeve 101 and ball 503 starts ascent. Coupled ball 503 and ball lift sleeve 101 makes contact with the descending lift sleeve 502 of plunger lift well 501 at which point it is inserted into lift sleeve 502 transferring upward lift to lift sleeve 502. Ball lift sleeve 101 descends back toward the bumper spring 505 and awaits the ball 503 to drop and be disposed in ball seat 102 of ball lift sleeve 101, acting as check valve holding fluid in tubing 504 until next cycle.

Figure 6:
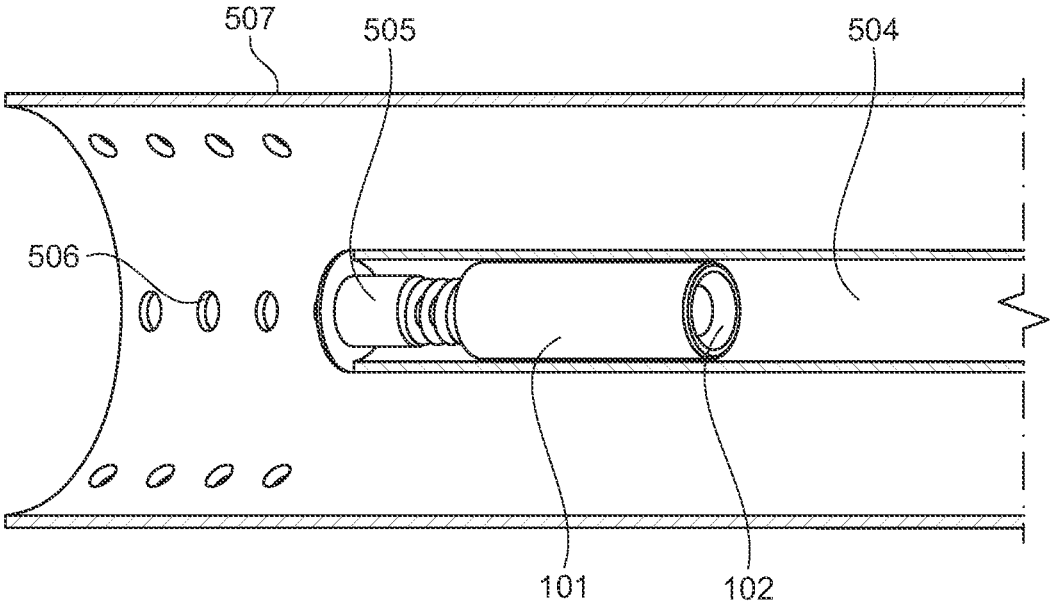
FIG. 6 illustrates a partial side perspective view of ball lift sleeve and bumper spring disposed in tubing.

FIG. 6 illustrates a partial side perspective view of ball lift sleeve 101 and bumper spring 505 disposed in tubing 504.

Figure 7:
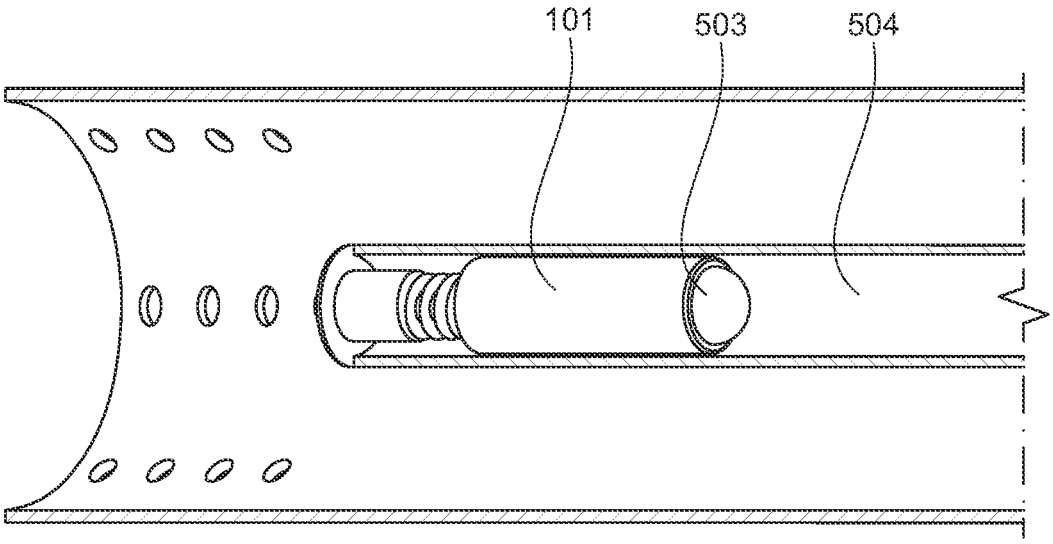
FIG. 7 illustrates a partial side perspective view of ball lift sleeve with ball and bumper spring disposed in tubing.

FIG. 7 illustrates a partial side perspective view of ball lift sleeve 101 with ball 503 and bumper spring 505 disposed in tubing 504. Ball 503 is disposed in ball seat 102 of ball lift sleeve 101.

Figure 8:
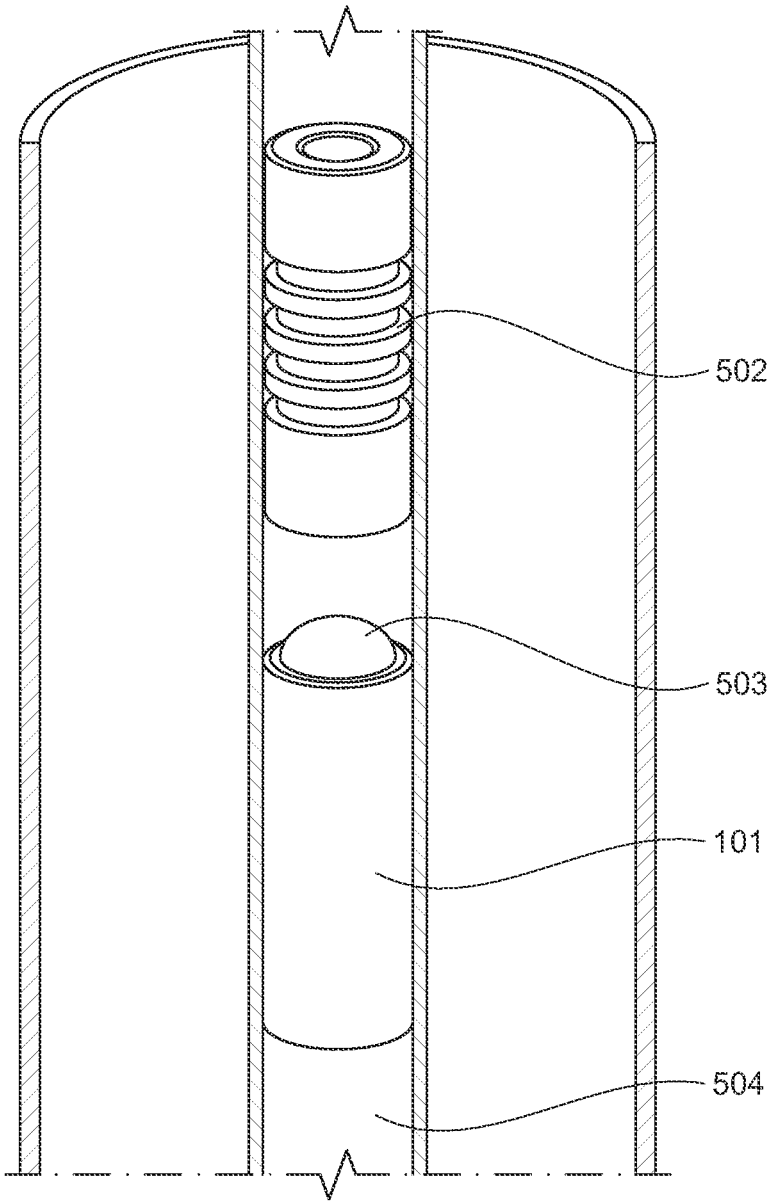
FIG. 8 illustrates a partial side perspective view of lift sleeve and ball disposed in ball lift sleeve.

FIG. 8 illustrates a partial side perspective view of lift sleeve 502 and ball 503 disposed in ball lift sleeve 101.

Figure 9:
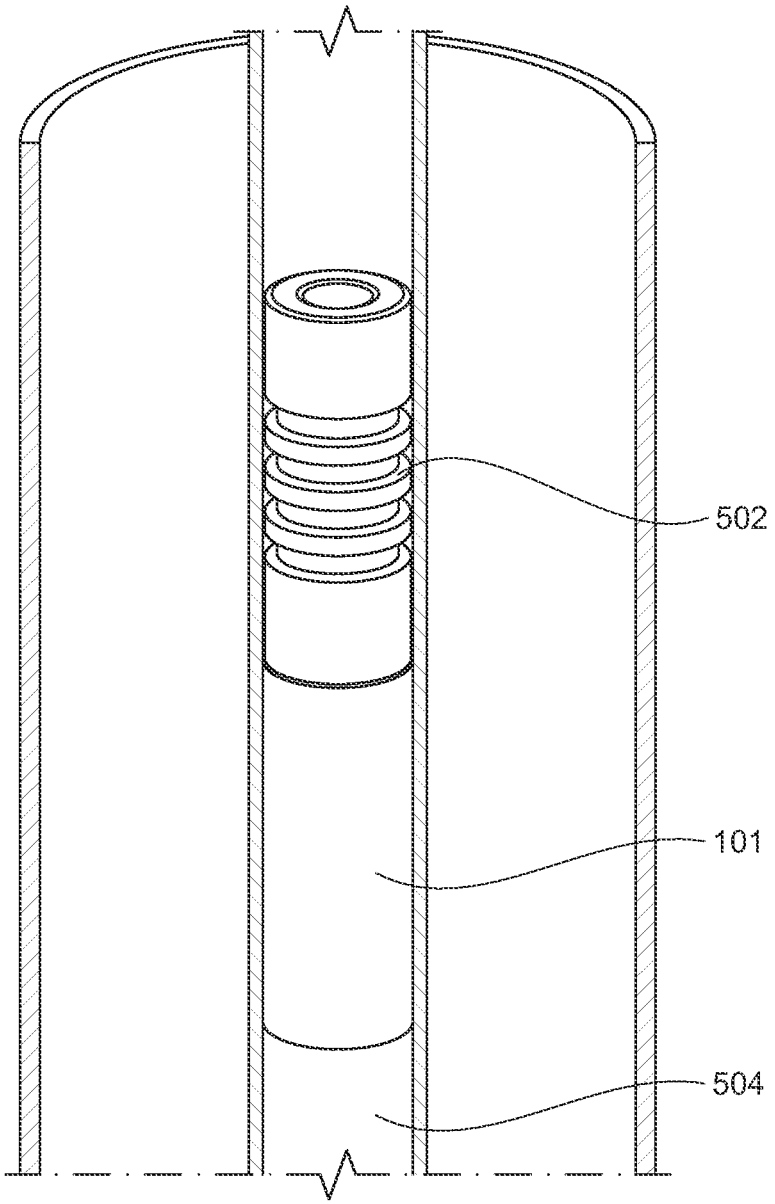
FIG. 9 illustrates a partial side perspective view of coupled lift sleeve and ball lift sleeve disposed in tubing.

FIG. 9 illustrates a partial side perspective view of coupled lift sleeve 502 and ball lift sleeve 101 disposed in tubing 504.

Figure 10:
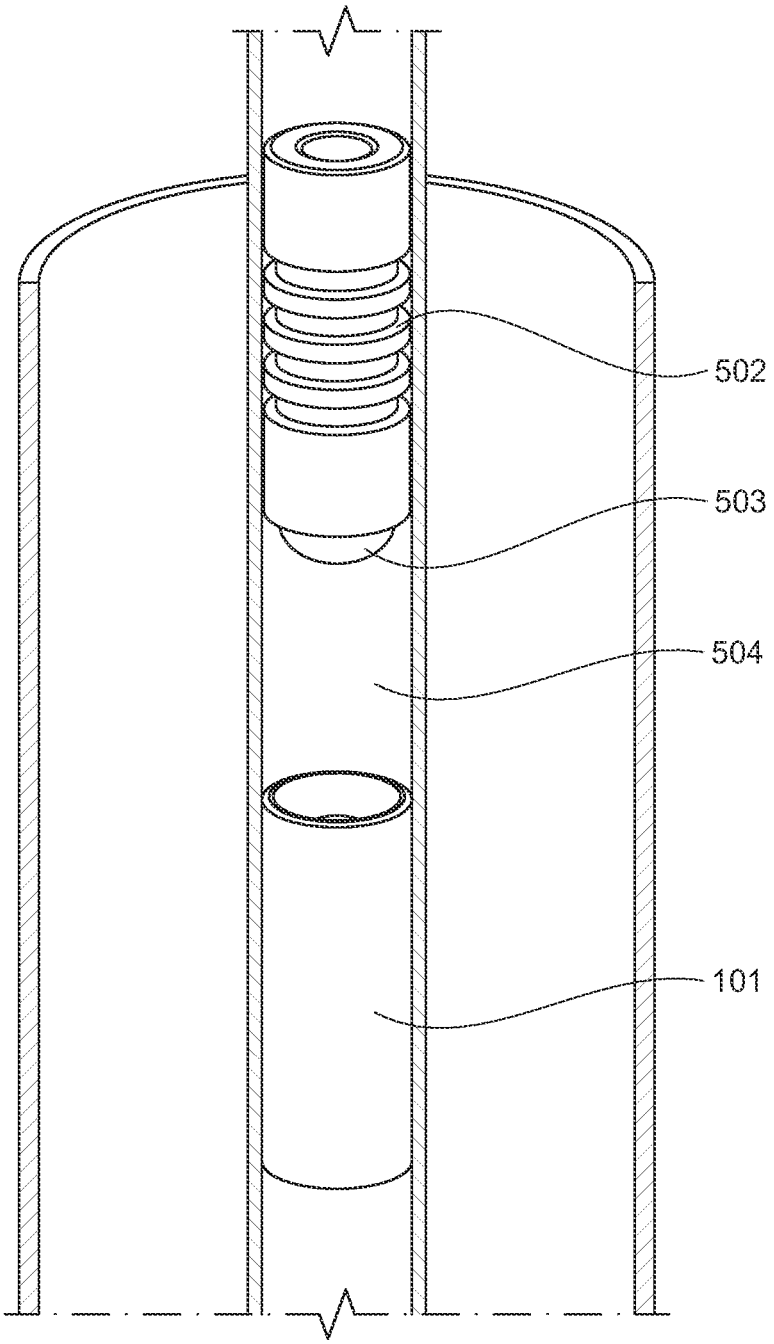
FIG. 10 illustrates a partial side perspective view of ball lift sleeve and ball disposed in lift sleeve.

FIG. 10 illustrates a partial side perspective view of ball lift sleeve 101 and ball 503 disposed in lift sleeve 502.

Figure 11:
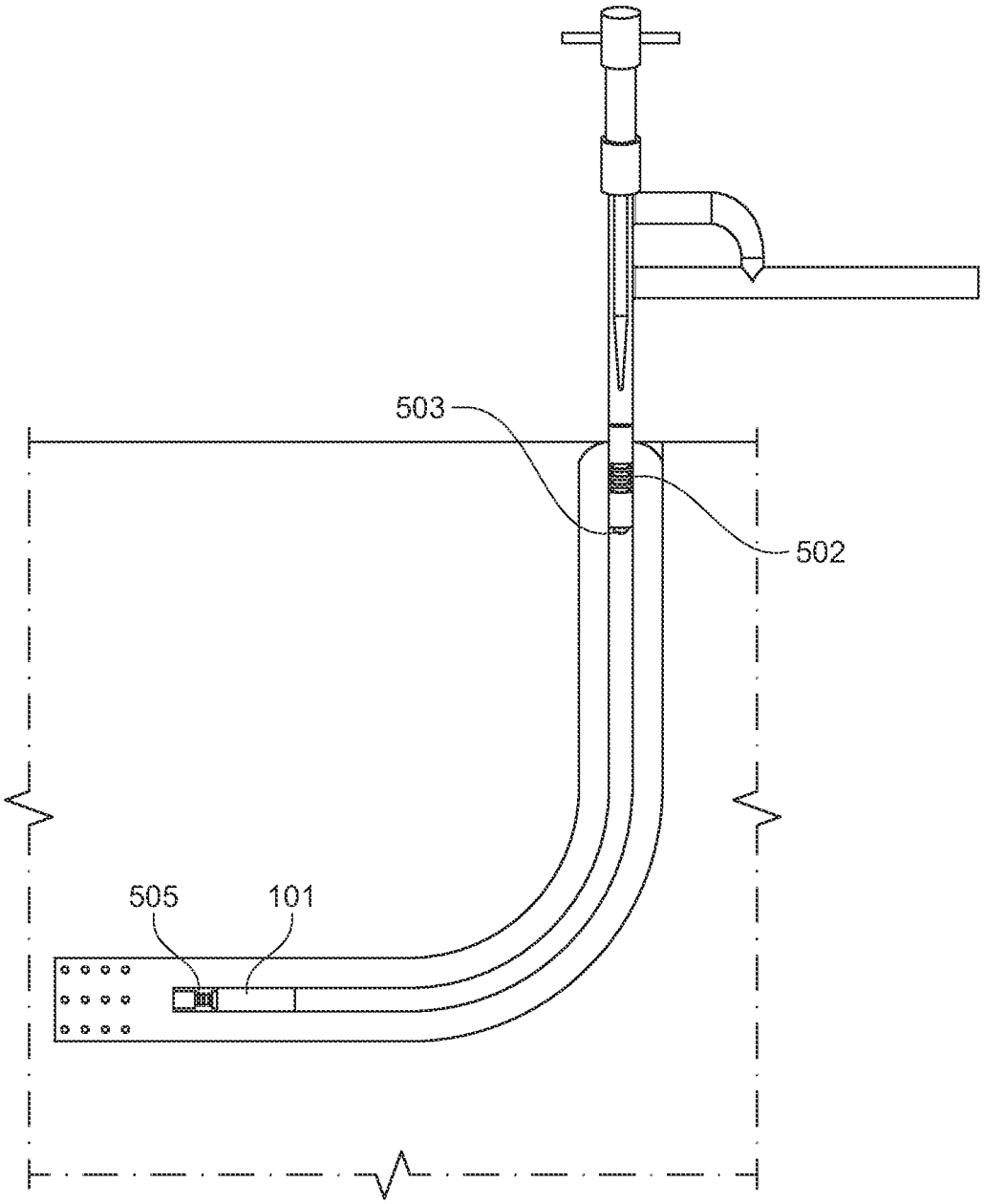
FIG. 11 illustrates a schematic representation of a plunger lift well.

FIG. 11 illustrates a schematic representation of a plunger lift well 501. Lift sleeve 502 is disposed in tubing 504. Ball 503 is disposed in lift sleeve 502. Ball lift sleeve 101 has disengaged with ball 503 and lift sleeve 502, falling down the well and contacting bumper spring 505. At this point, upward lift has been transferred to the plunger, created by the coupled ball 503 and lift sleeve 502.

Figure 12:
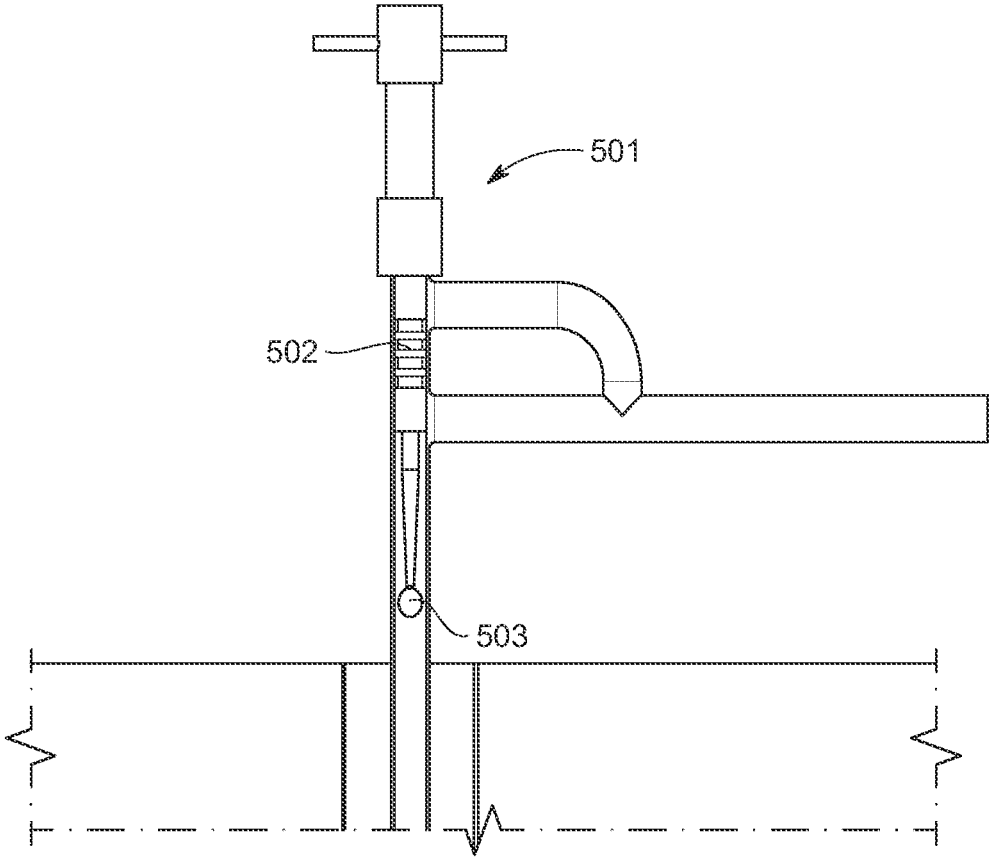
FIG. 12 illustrates a schematic representation of a plunger lift well, lift sleeve, and ball.

FIG. 12 illustrates a schematic representation of a plunger lift well 501, lift sleeve 502, and ball 503.

Figure 13:
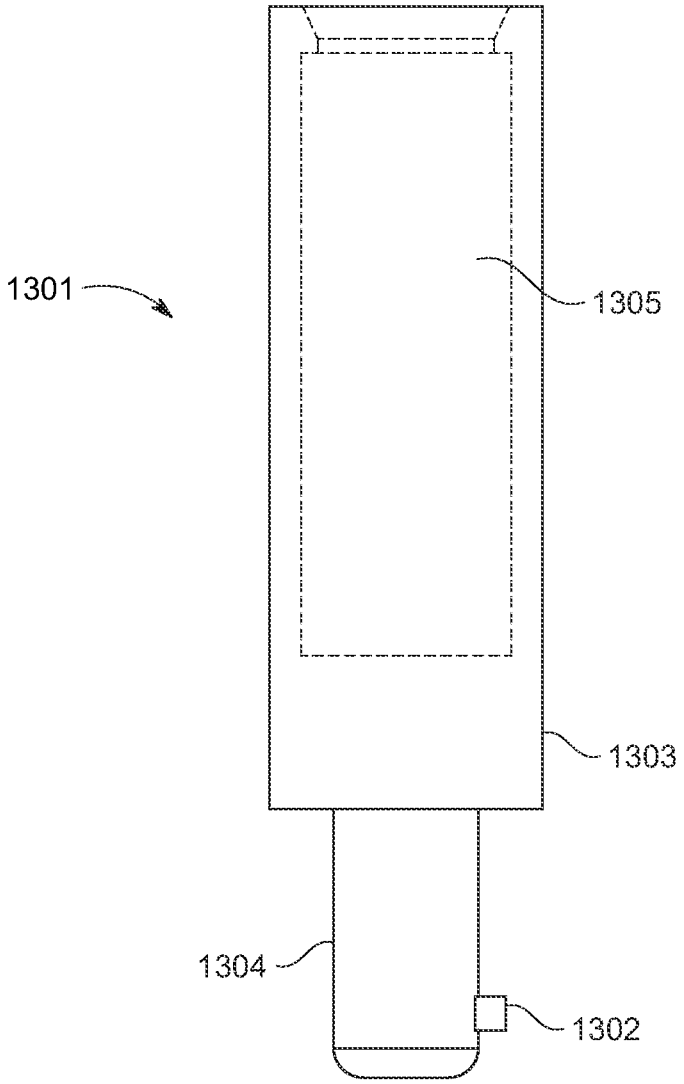
FIG. 13 illustrates a cross-sectional side elevation view of ball lift sleeve retrieval tool.

FIG. 13 illustrates a cross-sectional side elevation view of ball lift sleeve retrieval tool 1301. The ball lift sleeve retrieval tool 1301 is only used if ball lift sleeve 101 becomes stuck or needs to be inspected. Ball lift sleeve retrieval tool 1301 comprises ball lift sleeve retrieval tool main body 1303 and ball lift sleeve retrieval tool male receiver 1304. Ball lift sleeve retrieval tool catch 1302 is disposed on ball lift sleeve retrieval tool male receiver 1304. When ball lift sleeve retrieval tool 1301 and sleeve 101 are mated together, they move uphole within tubing 504 by application of a pressure differential.

Ball lift sleeve retrieval tool 1301 contains inner diameter hollow section 1305 which begins at the top of ball lift sleeve retrieval tool 1301 and extends partially through ball lift sleeve retrieval tool main body 1303. Inner diameter hollow section 1305 is used in case a commercial tool is needed to retrieve ball lift sleeve retrieval tool 1301 from tubing 504. Commonly used commercial tools are standard in the industry for retrieving plungers and fit into inner diameter hollow section 1305.

Figure 14:
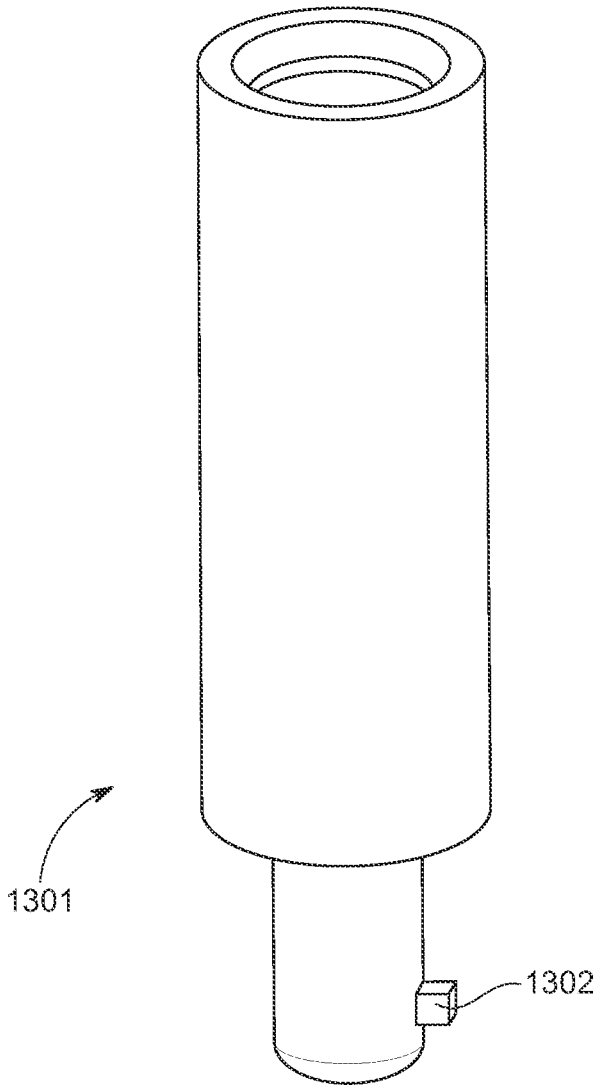
FIG. 14 illustrates a partial side perspective view of the ball lift sleeve retrieval tool and ball lift sleeve retrieval tool catch.

FIG. 14 illustrates a partial side perspective view of the ball lift sleeve retrieval tool 1301 and ball lift sleeve retrieval tool catch 1302.

Figure 15:
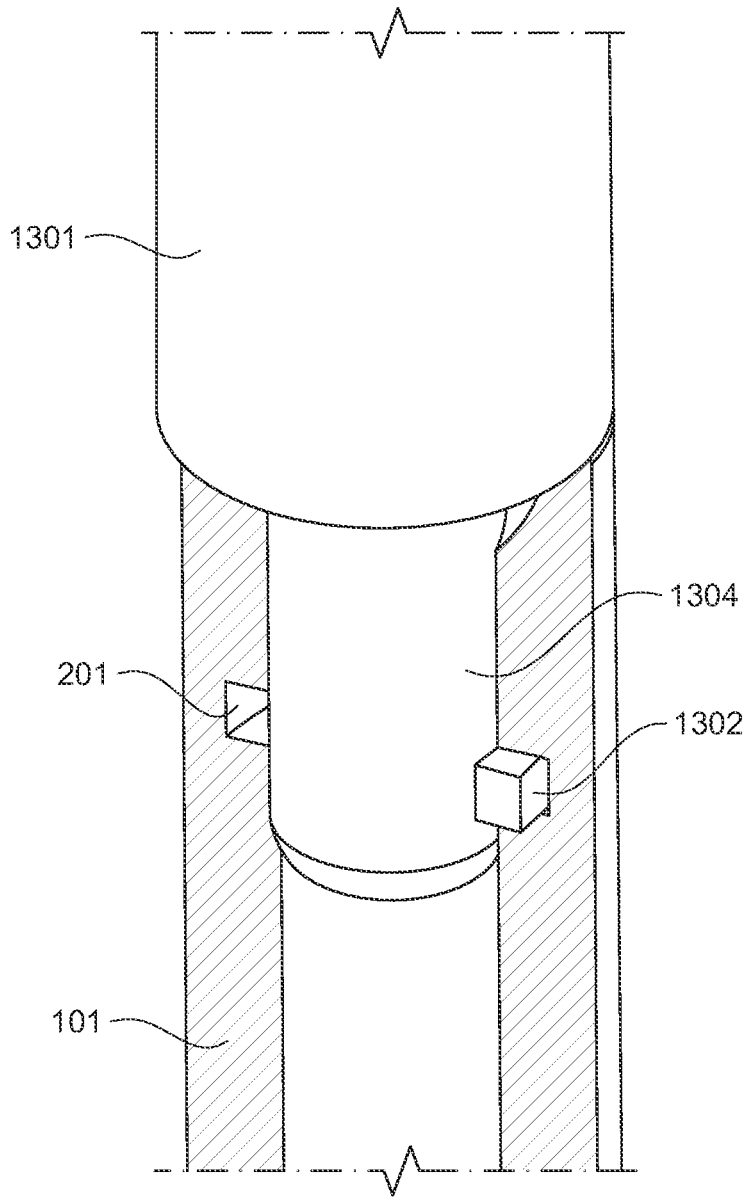
FIG. 15 illustrates a cut-away side perspective view of the ball lift sleeve and ball lift sleeve retrieval tool.

FIG. 15 illustrates a cut-away side perspective view of the ball lift sleeve 101 and ball lift sleeve retrieval tool 1301. Ball lift sleeve retrieval tool male receiver 1304 of ball lift sleeve retrieval tool 1301 is disposed in ball lift sleeve 101. Ball lift sleeve retrieval tool catch 1302 is disposed in catch groove 201. Means for releasing ball lift sleeve retrieval tool catch 1302 allows for the de-coupling of ball lift sleeve retrieval tool 1301 and ball lift sleeve 101.

Figure 16:
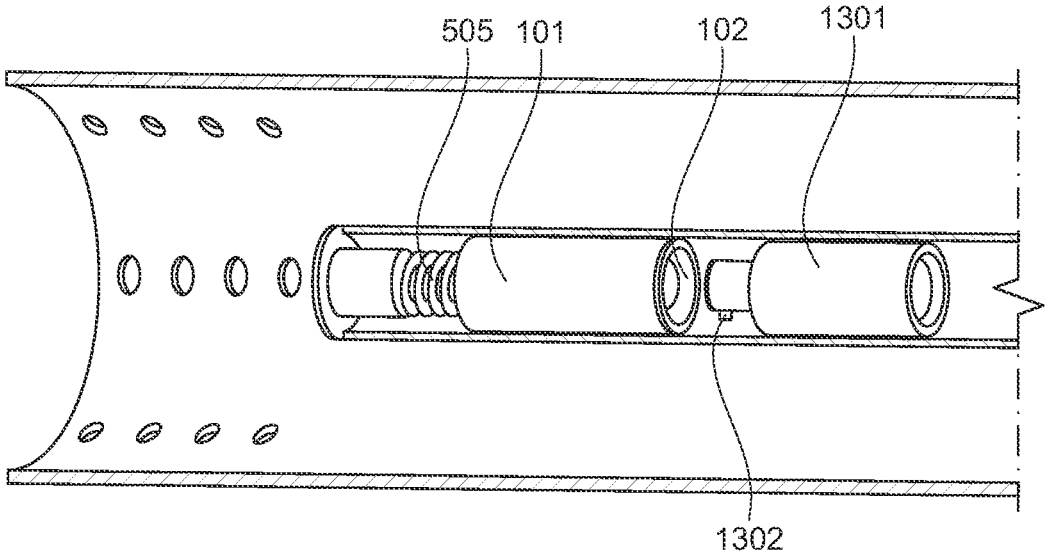
FIG. 16 illustrates a partial side perspective view of ball lift sleeve and ball lift sleeve retrieval tool.

FIG. 16 illustrates a partial side perspective view of ball lift sleeve 101 and ball lift sleeve retrieval tool 1301. Ball lift sleeve retrieval tool 1301 is not yet in contact with ball lift sleeve 101. The diameter of ball lift sleeve retrieval tool 1301 is such that it fits snugly in tubing 504.

Figure 17:
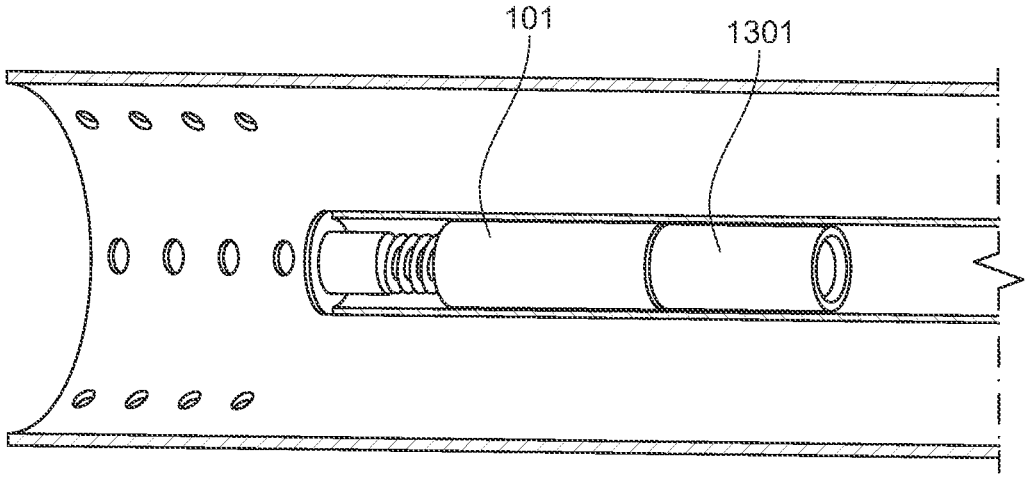
FIG. 17 illustrates a partial side perspective view of ball lift sleeve, ball lift sleeve retrieval tool, and bumper spring.

FIG. 17 illustrates a partial side perspective view of ball lift sleeve 101, ball lift sleeve retrieval tool 1301, and bumper spring 505. At this point, ball lift sleeve retrieval tool catch 1302 is securably disposed in catch groove 201, and ball lift sleeve 101 and ball lift sleeve retrieval tool 1301 are securably attached. Ball lift sleeve 101 is disposed on bumper spring 505, allowing for ball lift sleeve retrieval tool 1301 to be inserted into ball lift sleeve 101.

Figure 18:
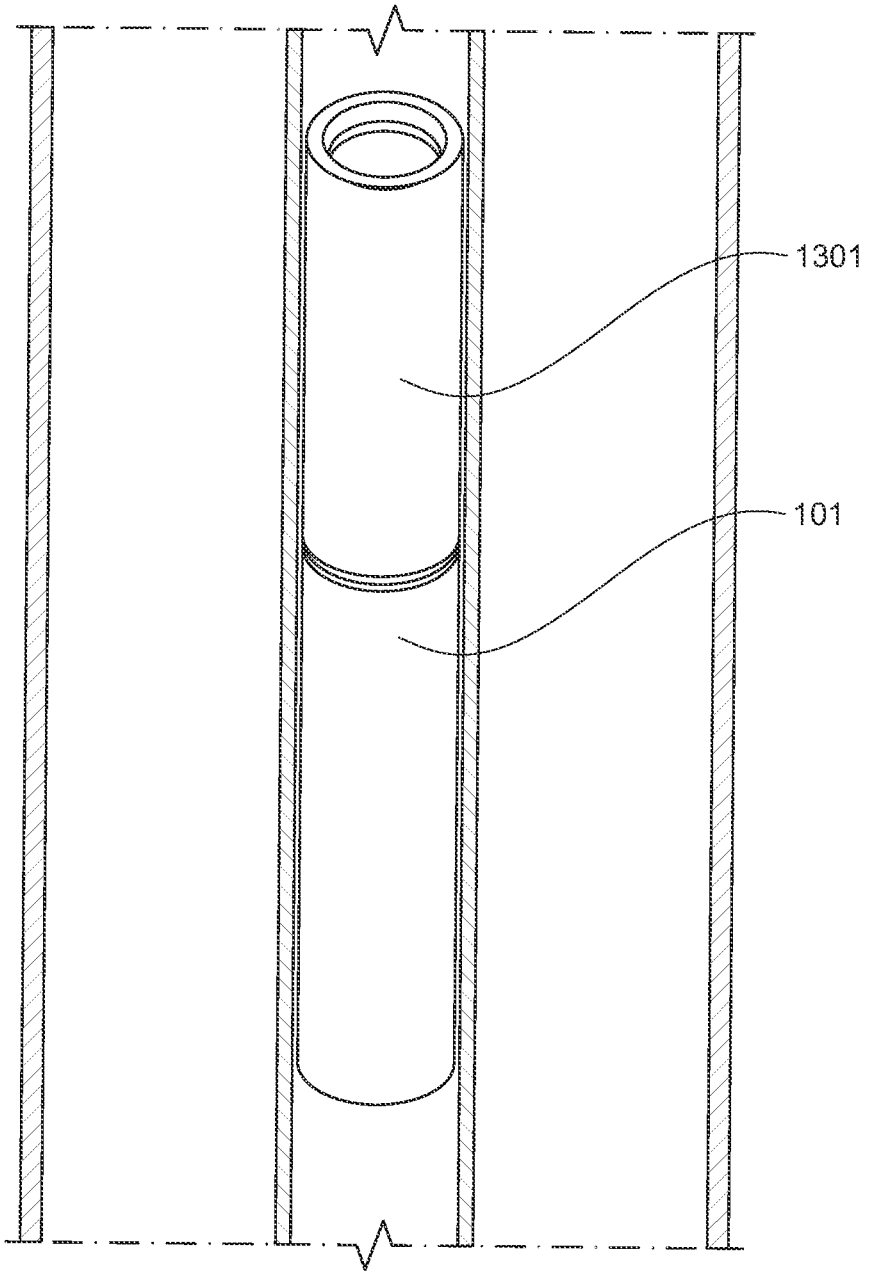
FIG. 18 illustrates a partial side perspective view of ball lift sleeve, ball lift sleeve retrieval tool, and bumper spring.

FIG. 18 illustrates a partial side perspective view of ball lift sleeve 101, ball lift sleeve retrieval tool 1301, and bumper spring 505. Ball lift sleeve 101 and ball lift sleeve retrieval tool 1301 are securably attached.

Figure 19:
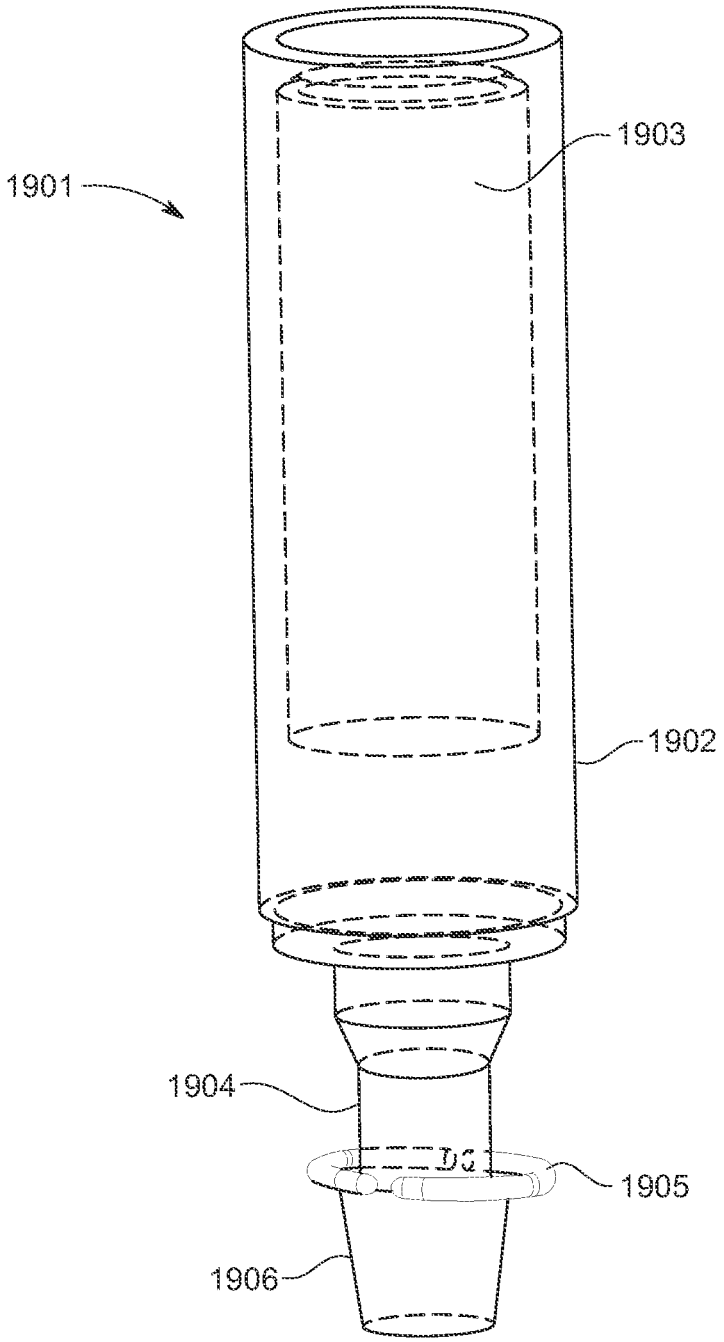
FIG. 19 illustrates a cross-sectional side elevation view of alternate ball lift sleeve retrieval tool.

In an alternate embodiment of the present invention, FIG. 19 illustrates a cross-sectional side elevation view of alternate ball lift sleeve retrieval tool 1901. The alternate ball lift sleeve retrieval tool 1901 functions similarly to ball lift sleeve retrieval tool 1301 and is only used if ball lift sleeve 101 becomes stuck or needs to be inspected. Alternate ball lift sleeve retrieval tool 1901 comprises alternate ball lift sleeve retrieval tool main body 1902, alternate ball lift sleeve retrieval tool male receiver 1906, alternate ball lift sleeve retrieval tool mid-section 1904, and D-rings 1905. D-rings 1905 are attached rotatably to alternate ball lift sleeve retrieval tool mid-section 1904 such that D-rings 1905 can be rotated toward alternate ball lift sleeve retrieval tool main body 1902, while remaining attached to alternate ball lift sleeve retrieval tool mid-section 1904. When alternate ball lift sleeve retrieval tool 1901 is in the upright position, D-rings 1905 rest on alternate ball lift sleeve retrieval tool male receiver 1906. Alternate ball lift sleeve retrieval tool male receiver 1906 fits snugly in flow thru 202 of ball lift sleeve 101.

Alternate ball lift sleeve retrieval tool 1901 contains alternate inner diameter hollow section 1903 which begins at the top of alternate ball lift sleeve retrieval tool 1901 and extends partially through alternate ball lift sleeve retrieval tool main body 1902. Alternate inner diameter hollow section 1903 is used in case a commercial tool is needed to retrieve alternate ball lift sleeve retrieval tool 1901 from tubing 504. Commonly used commercial tools are standard in the industry for retrieving plungers and fit into alternate inner diameter hollow section 1903.

Figure 20:
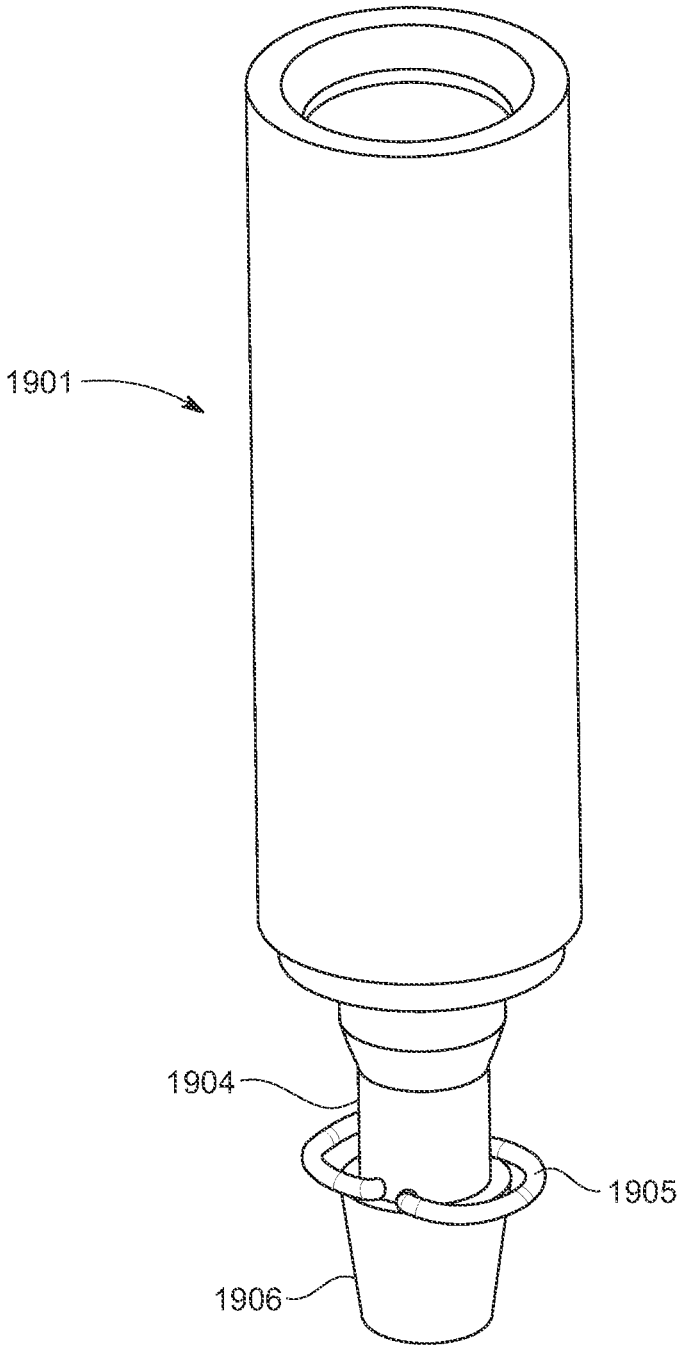
FIG. 20 illustrates a partial side perspective view of the alternate ball lift sleeve retrieval tool, alternate ball lift sleeve retrieval tool male receiver, alternate ball lift sleeve retrieval tool mid-section, and D-rings.

FIG. 20 illustrates a partial side perspective view of the alternate ball lift sleeve retrieval tool 1901, alternate ball lift sleeve retrieval tool male receiver 1906, alternate ball lift sleeve retrieval tool mid-section 1904, and D-rings 1905.

Figure 21:
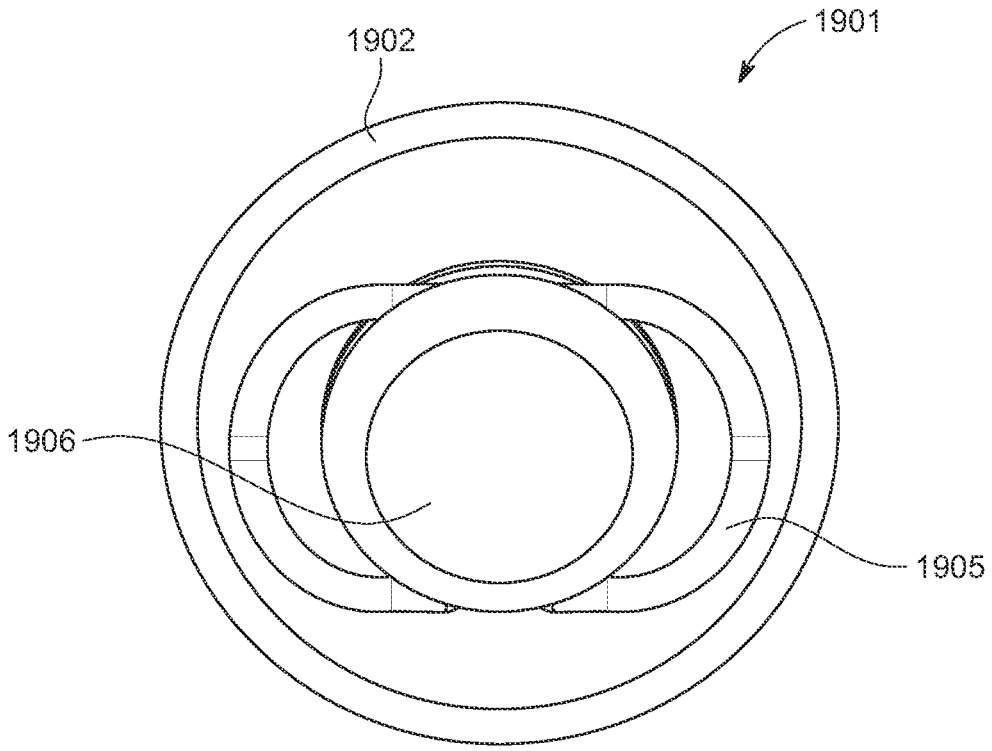
FIG. 21 illustrates a bottom up view of the alternate ball lift sleeve retrieval tool, comprising alternate ball lift sleeve retrieval tool male receiver, alternate ball lift sleeve retrieval tool main body, and D-rings.

FIG. 21 illustrates a bottom up view of the alternate ball lift sleeve retrieval tool 1901, comprising alternate ball lift sleeve retrieval tool male receiver 1906, alternate ball lift sleeve retrieval tool main body 1902, and D-rings 1905.

Figure 22:
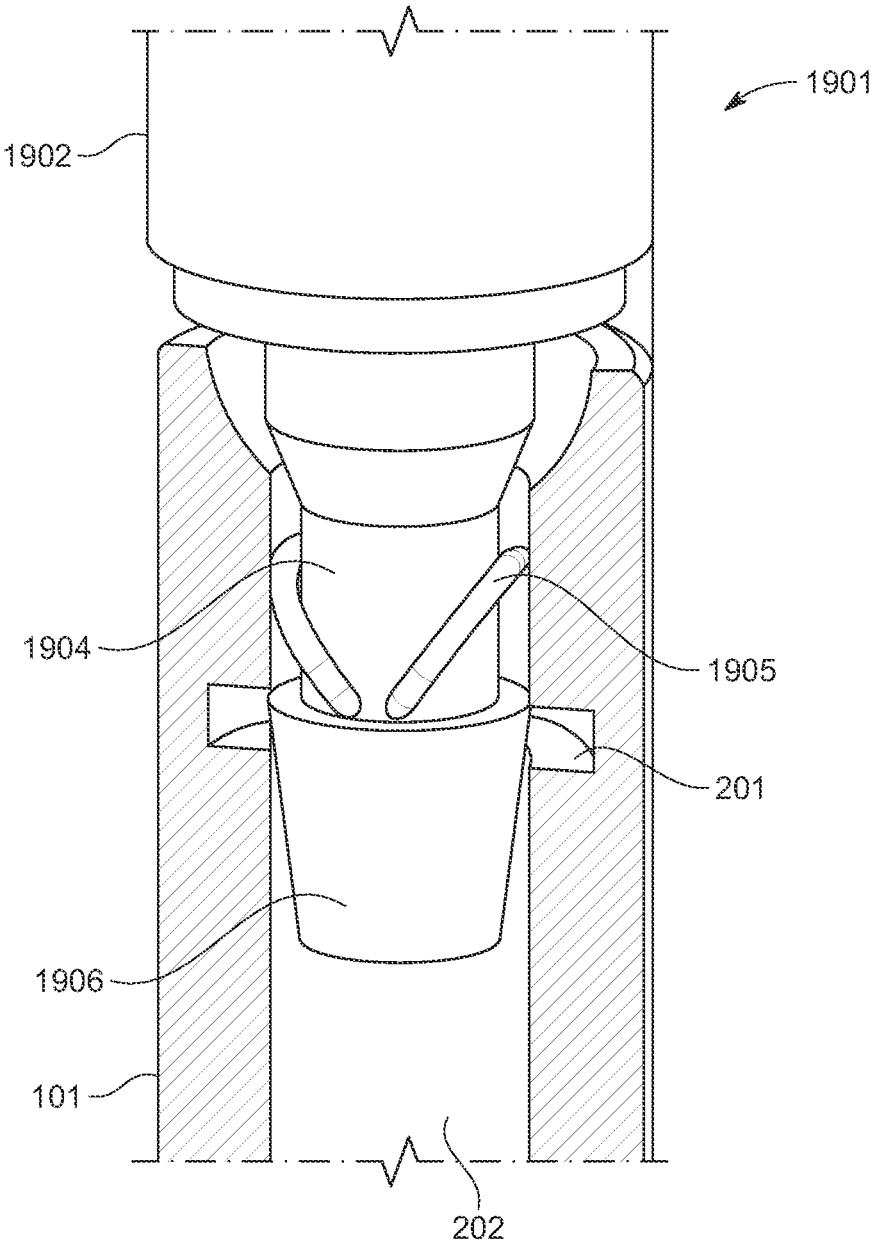
FIG. 22 illustrates a cut-away side perspective view of the ball lift sleeve and alternate ball lift sleeve retrieval tool.

FIG. 22 illustrates a cut-away side perspective view of the ball lift sleeve 101 and alternate ball lift sleeve retrieval tool 1901. Alternate ball lift sleeve retrieval tool male receiver 1906 and alternate ball lift sleeve retrieval tool mid-section 1904 are disposed in ball lift sleeve 101 via flow thru 202. D-rings 1905 pivot to allow for alternate ball lift sleeve retrieval tool 1901 to fit snugly into ball lift sleeve 101.

Figure 23:
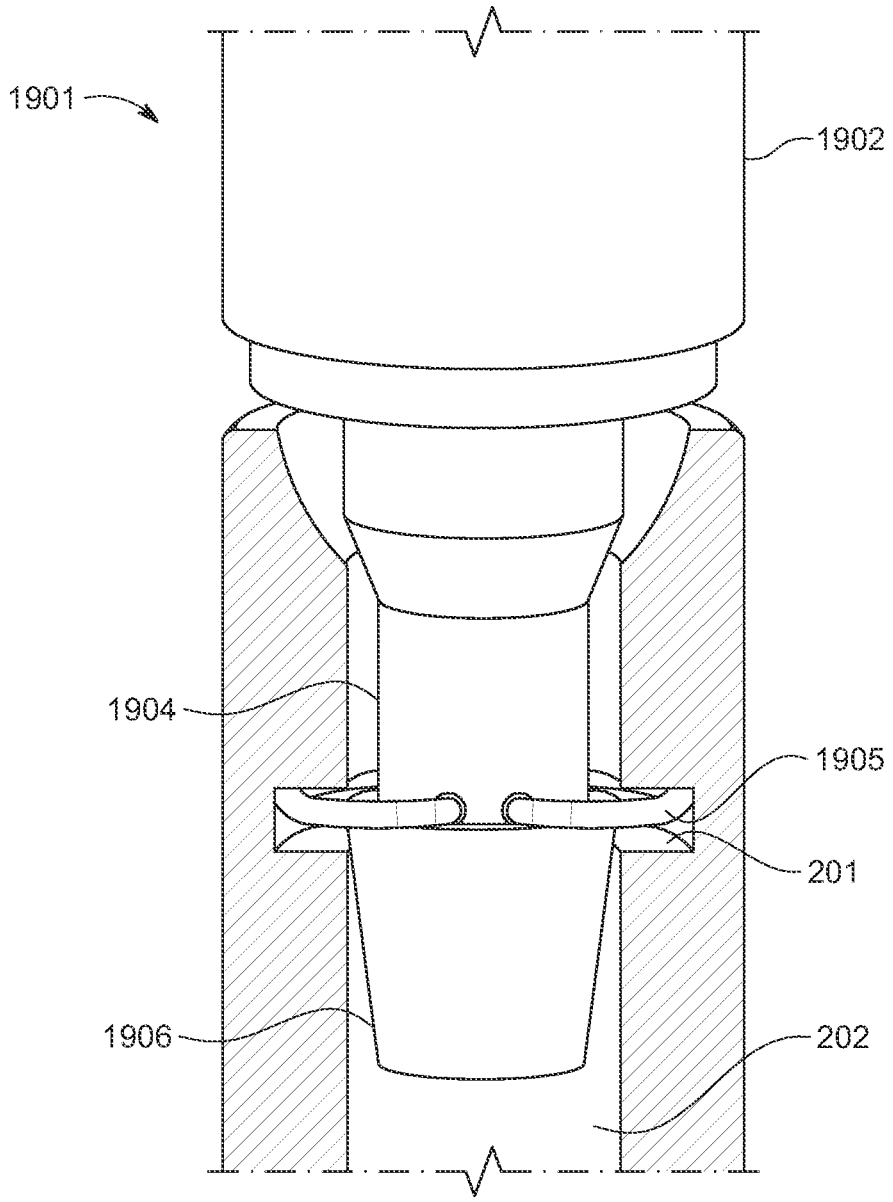
FIG. 23 illustrates a cut-away side perspective view of the ball lift sleeve and ball lift sleeve retrieval tool.

FIG. 23 illustrates a cut-away side perspective view of the ball lift sleeve 101 and alternate ball lift sleeve retrieval tool 1901. Alternate ball lift sleeve retrieval tool 1901 is now securably attached to ball lift sleeve 101 via D-rings 1905 disposed in catch groove 201.

Figure 24:
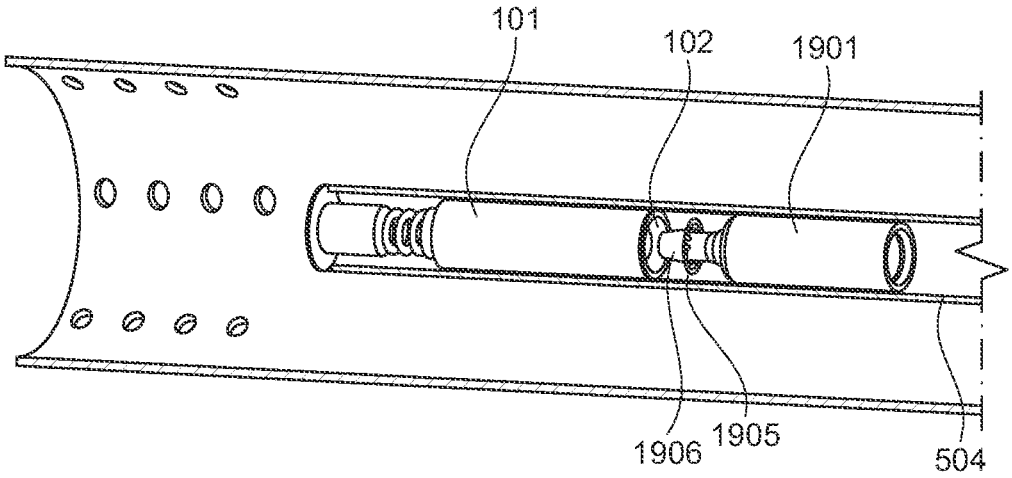
FIG. 24 illustrates a partial side perspective view of the ball lift sleeve and alternate ball lift sleeve retrieval tool in tubing.

FIG. 24 illustrates a partial side perspective view of the ball lift sleeve 101 and alternate ball lift sleeve retrieval tool 1901 in tubing 504. The diameter of alternate ball lift sleeve retrieval tool 1901 is such that it fits snugly in tubing 504.

Figure 25:
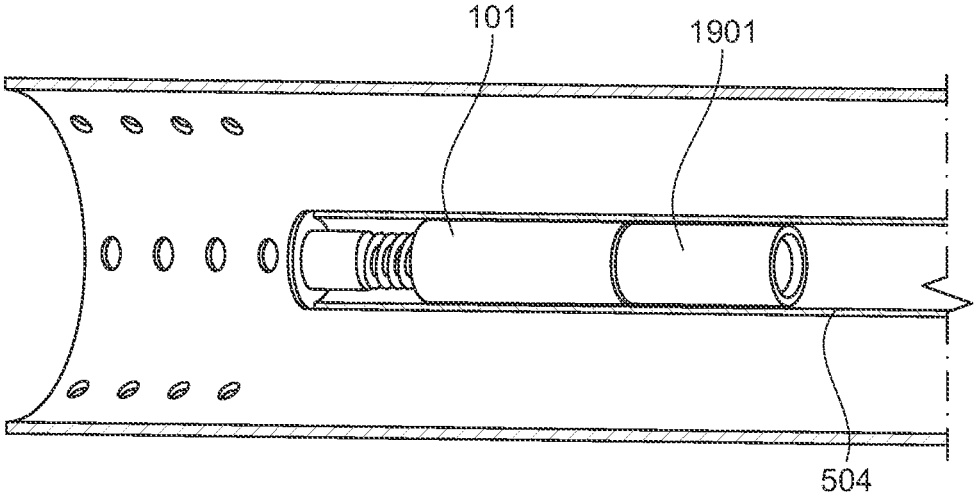
FIG. 25 illustrates a side perspective view of the ball lift sleeve and alternate ball lift sleeve retrieval tool in tubing.

FIG. 25 illustrates a side perspective view of the ball lift sleeve 101 and alternate ball lift sleeve retrieval tool 1901 in tubing 504. Ball lift sleeve 101 and alternate ball lift sleeve retrieval tool 1901 are securably attached.

In one embodiment of the present invention, any number of of D-rings are present.

In one embodiment of the present invention, inner diameter hollow section 1305 contains a catch groove, like catch groove 201, to allow multiple ball lift sleeve retrieval tools to be attached to each other as needed.

In additional embodiments of the present invention, any means to allow the ball lift sleeve retrieval tool to form a connection with the ball lift sleeve for them jointly to be pulled from the well are present.

The present invention reduces wear by minimizing dry runs because it traps liquid in tubing during after flow cycle by standing valve characteristics incorporated by the present invention and reducing hazards and damage at surface. The present invention will operate in flow transition areas. The present invention moves up to transition flow area to deliver ball to lifting sleeve and start unloading well in smaller runs working its way back to bottom. Properties of surface tension included in the design of the present invention allows this if minimal flow is achieved. In horizontal wellbores, the bumper spring of the present invention is set in an approximately 40 degree angle (although angle can vary greatly) greatly increasing side friction, thus slowing and stopping sleeve often or pushing it back up to the vertical section of the tubing until the sleeve weight overcomes the opposing flow to try its dissent again to the ball (the Yo-Yo effect).

This cycle can happen many times before a seal can occur making the return trip to surface, causing excessive erosion of lower tubing joints and sleeve. The present invention moves the liquid load and ball (seal) transferring liquid above sleeve and sealing it for trip to surface, thus shorting run times and minimizing missed runs. The present invention can be used to supplement all other lifting plunger types because it can go deeper and operate at greater angles to deliver loads to where other plungers stop moving because of tight curves and loss of gravitational force in the horizontal section of tubing. The present invention can be retrieved to be checked or replaced easily with a plunger extraction tool, eliminating expensive wire lines. This reduces required energy supplements because of optimization of every run, no wasting energy on short runs, dry runs and missed runs. The required skill level and time of operator is minimized. If the present invention stops, it will start again by itself, giving operators a second chance or third if need to get it running right. This results in overall increased production.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying drawings are to be interpreted in an illustrative and non-limiting sense.

What is claimed is:

1. A plunger lift well comprising:

a tubing extending inside a casing production string of a well and having a first end through which oil and gas enters the tubing from the well;

a lift sleeve arranged inside the tubing and adapted to move inside the tubing;

a ball lift sleeve arranged inside the tubing between the first end and the lift sleeve, the ball lift sleeve is adapted to move inside the tubing and defines a first passage extending from a first proximal end to a first distal end and a ball seat at the first distal end; and a ball disposed inside the tubing between the ball lift sleeve and the lift sleeve, wherein the ball is seated at the ball seat during a start of an operation of the well and the ball and the ball lift sleeve moves together towards the lift sleeve due to a pressure differential across the ball lift sleeve, wherein the ball is adapted to contact the lift sleeve and engages with the lift sleeve upon contacting the lift sleeve, and wherein the ball and the lift sleeve move together in a direction away from the first end of the tubing and the ball lift sleeve moves towards the first end upon engagement of the ball with the lift sleeve.

2. The plunger lift well of claim 1 further including a bumper spring arranged at the first end of the tubing, wherein the ball lift sleeve is adapted to contact the bumper spring.

3. The plunger lift well of claim 2, wherein the ball when seated on the ball seat seals a fluid flow through the first passage.

4. The plunger lift well of claim 1, wherein the ball lift sleeve comprises means for producing a pressure differential across the ball lift sleeve.

5. The plunger lift well of claim 1, wherein an inner surface of the ball lift sleeve defines a catch groove arranged between the first proximal end and the ball seat.

6. The plunger lift well of claim 1 further including a retrieval tool adapted to be removably inserted inside the tubing and adapted to engage with the ball lift sleeve to facilitate a removal of the ball lift sleeve from the tubing.

7. The plunger lift well of claim 6, wherein the retrieval tool includes a male receiver adapted to insert inside the first passage of the ball lift sleeve to enable the engagement of the retrieval tool with the ball lift sleeve.

8. The plunger lift well of claim 7, wherein the ball lift sleeve includes a catch groove, and the retrieval tool includes a tool catch extending radially outwardly from the male receiver adapted to be inserted inside the catch groove to facilitate the engagement of the retrieval tool and the ball lift sleeve.

* * * * *